US005769607A

United States Patent [19]

Neely et al.

[11] Patent Number: 5,769,607

[45] Date of Patent: Jun. 23, 1998

[54] HIGH-PUMPING, HIGH-EFFICIENCY FAN WITH FORWARD-SWEPT BLADES

[75] Inventors: Michael J. Neely, Dayton; Michael Brendel, Centerville; John R. Savage, Kettering, all of Ohio

[73] Assignee: ITT Automotive Electrical Systems, Inc., Auburn Hills, Mich.

[21] Appl. No.: 795,417

[22] Filed: Feb. 4, 1997

[51] Int. Cl.[6] ..... F04D 29/38

[52] U.S. Cl. ..... 416/189; 416/169 A; 416/DIG. 5

[58] Field of Search ..... 415/169 A, 179, 415/189, DIG. 2, DIG. 5

[56] References Cited

U.S. PATENT DOCUMENTS

| | | | |
|---|---|---|---|
| 4,358,245 | 11/1982 | Gray . | |
| 4,569,631 | 2/1986 | Gray, III . | |
| 4,684,324 | 8/1987 | Perosino . | |
| 4,737,077 | 4/1988 | Vera | 416/169 A |
| 4,900,229 | 2/1990 | Brackett et al. | 416/189 |
| 5,064,345 | 11/1991 | Kimball . | |
| 5,211,187 | 5/1993 | Lorea et al. | 416/189 |
| 5,244,347 | 9/1993 | Gallivan et al. . | |
| 5,326,225 | 7/1994 | Gallivan et al. . | |
| 5,393,199 | 2/1995 | Alizadeh | 416/189 |
| 5,582,507 | 12/1996 | Alizadeh | 416/189 |
| 5,624,234 | 4/1997 | Neely et al. | 416/189 |

*Primary Examiner*—John T. Kwon
*Attorney, Agent, or Firm*—Thomas N. Twomey; J. Gordon Lewis

[57] ABSTRACT

A blade for a vehicle engine-cooling fan assembly. The blade combines a particular distribution of four, key, blade-design parameters—planform sweep, airfoil chord, maximum airfoil camber, and airfoil pitch angle—to achieve a fan assembly having high pumping, high efficiency, and low noise. Specifically, the blade has a planform with a forward sweep angle continuously increasing in absolute value along the span from the root to a maximum absolute value not exceeding about 15 degrees at the tip. The airfoil of the blade has a chord that continuously increases from the root to the tip, a maximum camber that continuously decreases from a value not greater than about 12% of chord at the root to a value not less than about 5% of chord at the tip, and a solidity not greater than about 1.1 at the root and not less than about 0.5 at the tip. The pitch angle of the airfoil of the blade defines three, separate regions: (a) a first region in which the pitch angle continuously decreases from the root, where the pitch angle has a value not exceeding about 120% of the tip pitch angle, to about the ½-span location; (b) a second region in which the pitch angle continuously increases from about the ½-span location, where the pitch angle has a value not less than about 80% of the tip pitch angle, to about the ⅞-span location; and (c) a third region in which the pitch angle continuously decreases from about the ⅞-span location, where the pitch angle has a value not exceeding about 105% of the tip pitch angle, to the tip.

20 Claims, 12 Drawing Sheets

HIGH-PUMPING, HIGH-EFFICIENCY FAN WITH FORWARD-SWEPT BLADES

FIELD OF THE INVENTION

This invention relates generally to a vehicle engine-cooling fan assembly and, more particularly, to the fan blade of such an assembly. The fan blade combines a particular distribution of four, key, blade-design parameters—airfoil pitch angle, planform sweep, airfoil chord, and maximum airfoil camber—to achieve a fan assembly having high pumping, high efficiency, and low noise.

BACKGROUND OF THE INVENTION

A multi-bladed cooling air fan assembly 10 according to the present invention is shown in FIG. 1. Designed for use in a land vehicle, fan assembly 10 induces air flow through a radiator to cool the engine. Fan assembly 10 has a hub 12 and an outer, rotating ring 14 that prevents the passage of recirculating flow from the outlet to the inlet side of the fan. Although it must have a hub 12, fan assembly 10 need not have a ring 14. A plurality of blades 100 (nine are shown in FIG. 1) extend radially from hub 12 (where the root of each blade 100 is joined) to ring 14 (where the tip of each blade 100 is joined).

Fan assembly 10 rotates about an axis 20 that passes through the center of hub 12 and is perpendicular to the plane of fan assembly 10 in FIG. 1. As fan assembly 10 rotates about the axis, in the counter-clockwise direction illustrated by arrow 16, the mechanical power imparted to fan assembly 10 (from an electric motor, a hydraulic motor, or some other source) is converted to flow power. Flow power is defined as the product of the volumetric flow rate and the pressure rise generated by fan assembly 10. Efficiency is defined as the ratio of flow (output) power to motor (input) power.

Fan assembly 10 must accommodate a number of diverse considerations. For example, when fan assembly 10 is used in an automobile, it is typically placed behind a heat exchanger which may be the radiator, the air conditioning condenser, or both. Consequently, fan assembly 10 must be compact to meet space limitations in the engine compartment. Fan assembly 10 must also be efficient, avoiding wasted energy which directs air in turbulent flow patterns away from the desired axial flow; relatively quiet; and strong to withstand the considerable loads generated by air flows and centrifugal forces.

Environmental concerns have prompted replacement of the chlorinated fluorocarbon-containing refrigerants (such as R12) used in automotive air conditioning systems with non-CFC-containing refrigerants (such as R134a). The non-CFC refrigerants are less effective than the refrigerants they replace and require increased fan assembly airflow rates to provide performance equivalent to the CFC-containing refrigerants. If straight-bladed fan assemblies were used in the non-CFC-containing air conditioning systems, the assemblies would have to operate at higher speeds—thus causing increased airborne noise. Therefore, highly-curved blade planforms have been used to provide the air-moving performance required by the new air conditioning systems with acceptably low noise levels.

Other aspects of vehicle design, besides the switch to non-CFC-containing air conditioning systems, have prompted the use of high-pumping, high-efficiency blades. These aspects include styling (with closed front ends, smaller grilles, and the like) that increases the system restriction, the need for increased electrical efficiency which requires more efficient fan assemblies, reduced packaging space, reduced noise, and reduced mass.

Generally, fan blades are "unskewed." Such blades have a straight planform in which a radial center line of the blade is straight and the blade chords perpendicular to that line are uniformly distributed about the line. Occasionally, fan blades are forwardly skewed: the blade center line curves in the direction of rotation of the fan assembly as the blade extends radially from hub to ring. U.S. Pat. No. 4,358,245, assigned to Airflow Research and Manufacturing Corporation (ARMC), discloses a fan blade which has a continuous forward skew. U.S. Pat. No. 5,244,347 (assigned to Siemens Automotive Limited) also discloses a fan forwardly skewed blade.

Other fan blades are backwardly (away from the direction of fan rotation) skewed. General Motors Corporation has used a fan blade with a modest backward skew on its "X-Car." The blade angle of that fan blade increases with increasing diameter along the outer portion of the blades and the skew angle at the blade tip is about 40°. Still other fan blades are backwardly skewed in the root region of the blade adjacent the hub of the fan assembly and forwardly skewed in the tip region of the blade. U.S. Pat. Nos. 4,569,631 (also assigned to ARMC); 4,684,324; 5,064,345; and 5,326,225 (also assigned to Siemens) each disclose such a blade. Each of these references teaches a short, abrupt transition region (if any) between the root region of backward skew and the tip region of forward skew.

The skew of the fan blade is only one of the blade characteristics that affect performance of the fan assembly. To improve the operation of fan assemblies, much attention has focused on the design or shape of the blade airfoils. High pumping and efficiency are required to meet the ever-increasing operational standards for vehicle engine-cooling fan assemblies. There are many different airfoil shapes and slight variations in shape can alter the characteristics of the airfoil in one way or another.

Fan assembly 10 of FIG. 1 is an axial fan; that is, an air particle moving through fan assembly 10 traverses a path roughly parallel to the axis of rotation 20. The flow power produced by fan assembly 10 is proportional to the turning of the air as it passes from the inlet to the outlet plane. This turning is achieved by curved, or cambered, blade cross sections (also known as airfoils). In summary, blades 100 turn the air stream through fan assembly 10, thereby creating a pressure rise across the assembly.

FIG. 2 illustrates an airfoil 30 of blade 100 having a leading edge 32, a trailing edge 34, and substantially parallel surfaces 36 and 38. The chord of airfoil 30 is the straight line (represented by the dimension "C") extending directly across the airfoil from leading edge 32 to trailing edge 34. The camber is the arching curve (represented by the dimension "b") extending along the center or mean line 40 of airfoil 30 from leading edge 32 to trailing edge 34. Camber is measured from a line extending between the leading and trailing edges of the airfoil (i.e., the chord length) and mean line 40 of airfoil 30. Maximum camber, $b_{max}$, is the perpendicular distance from the chord line, C, to the point of maximum curvature on the airfoil mean line 40. A high camber provides high lift and, up to a limit, fan pumping is proportional to maximum airfoil camber. Excessive camber can produce separated flow, however, and a decrease in pumping.

As shown in FIG. 3, when airfoil 30 contacts a stream of air 18, the air stream engages leading edge 32 and separates into streams 42 and 44. Stream 42 passes along surface 36 while stream 44 passes along surface 38. As is well known, stream 42 travels a greater distance than stream 44, at a higher velocity, with the result that air adjacent to surface 36 is at a lower pressure than air adjacent to surface 38. Consequently, surface 36 is called the "suction side" of airfoil 30 and surface 38 is called the "pressure side" of airfoil 30. The pressure differential creates lift.

The operation of blade 100 having airfoil 30 can be illustrated using an inlet velocity diagram as shown in FIG. 2. The linear blade speed is represented by ωr, where omega (ω) is the angular speed of the blade and r is the radius. In an axial flow fan assembly 10, the air flow has components of velocity parallel to the axis of rotation of fan assembly 10 ($V_{ax}$) and to the tangential direction ($V_{tan}$)—but has little radial velocity. It is desirable to distinguish between the absolute velocity, $V_{abs}$, and the velocity relative to the moving blade 100, $V_{rel}$. The angle of attack for air stream 18 is represented by alpha (α) and "P" is the pitch angle of blade 100.

To overcome the shortcomings of conventional fan assemblies, a new fan assembly is provided. An objective of the present invention is to provide an engine-cooling fan assembly, including a plurality of blades, having high operational and air-pumping efficiency. Another objective is to reduce the noise created by the fan assembly. Yet another objective of the present invention is to provide a fan assembly in which the fan blades optimize the design trade-off between airfoil pitch angle, planform sweep, airfoil chord, and maximum airfoil camber. A related objective is to provide a blade in an engine-cooling fan assembly that provides high pressure rise across the fan assembly and reduced mass. Finally, it is an objective of the present invention to provide a blade design suitable for the entire range of engine-cooling fan assembly operation, including idle.

SUMMARY OF THE INVENTION

To achieve these and other objectives, and in view of its purposes, the present invention provides a blade (for a vehicle engine-cooling fan assembly) having a planform with a forward sweep angle continuously increasing in absolute value along the span from the root to the tip of the blade. The airfoil of the blade has a pitch angle defining three, separate regions: (a) a first region in which the pitch angle continuously decreases from the root to about the ½-span location, (b) a second region in which the pitch angle continuously increases from about the ½-span location to about the ⅞-span location, and (c) a third region in which the pitch angle continuously decreases from about the ⅞-span location to the tip.

More particularly, the sweep angle has a maximum absolute value not exceeding about 15 degrees at the blade tip. The pitch angle has a value at about the ⅞-span location not exceeding about 105% of the tip pitch angle, a value at about the ½-span location not less than about 80% of the tip pitch angle, and a value at the root not exceeding about 120% of the tip pitch angle. The airfoil also has a maximum camber that continuously decreases from the root to the tip and a chord that continuously increases from the root to the tip. Most particularly, the airfoil of the blade has a maximum camber that continuously decreases from a value not greater than about 12% of chord at the root to a value not less than about 5% of chord at the tip and a solidity not greater than about 1.1 at the root and not less than about 0.5 at the tip.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

A difficult problem in the design of axial fan assemblies such as fan assembly 10 has been the creation of a fan assembly that produces high pumping (i.e., high pressure rise at a given volume flow rate), high efficiency, and low noise. Noise reduction is obtained by sweeping the blade planform, in either the forward or backward direction, relative to blade rotation. Fan pumping decreases as blade sweep increases, however, resulting in a trade-off between pumping (pressure rise) and noise. Furthermore, the recent trend in automotive engine-cooling fan requirements has been toward increased fan pressure rise. This increase in pressure rise must be achieved with high fan efficiency and low fan noise.

Fan assembly 10 of the present invention produces high efficiency and high pumping with low noise. The improved performance is the result of a particular distribution of four, key, blade-design parameters: airfoil pitch angle, planform sweep, airfoil chord, and maximum airfoil camber. Each of these four blade parameters affects the performance of an axial-flow fan. The parameters, and their effect on fan performance, are summarized in Table 1 below:

TABLE 1

| Blade Parameter | | Pumping (kPa) | Noise (dB(A)) | Efficiency (%) |
|---|---|---|---|---|
| Camber | ↑ | ↑ | ↑/←→ | ↓ |
| Chord | ↑ | ↑ | ↑/←→ | ↓ |
| Sweep | ↑ | ↓ | ↓ | ↓ |
| Pitch | ↑ | ↑[1] | ↑/←→[2] | ↓/↑[3] |

Figure 14:
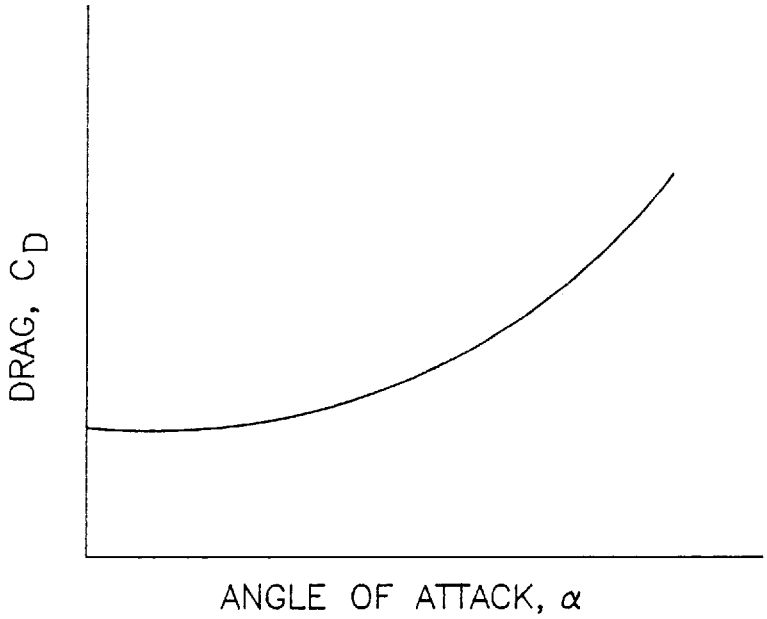
FIG. 14 is a graph of coefficient of drag ($C_D$) versus angle of attack (α) for a typical cambered airfoil.

[1]Pumping increases with increased pitch angle, up to the stall point.
[2]If pitch is excessive and stall occurs, then the separated boundary layer can produce noise.
[3]Efficiency increases or decreases depending on the shape of and position on a coefficient of drag ($C_D$) versus angle of attack curve ($\alpha$) such as the curve illustrated in FIG. 14.

The table above shows the general relationship between blade parameters and fan performance. Although exceptions to these trends may occur, Table 1 is useful for considering design trade-offs.

Automotive engine-cooling fans must perform efficiently at the design operating point (i.e., at one point on the flow versus pressure-rise curve). The fan must also provide adequate performance, however, at off-design conditions. The fan noise must not exceed levels considered annoying to a listener inside or outside the vehicle. Total sound power, measured in dB(A), is one measure of fan noise. In addition, the narrow-band spectrum must be analyzed to assure that the tonal quality of the fan noise is not objectionable.

The operating point of assembly 10 is the combination of airflow through the fan assembly and the pressure rise across the fan assembly; it is essentially the ratio of pressure to airflow including additional factors to provide non-dimensionalization. Higher value operating points indicate higher pressure rise and lower airflow operation. Lower values indicate higher airflow rates through, and lower pressure rise across, fan assembly 10.

The non-dimensional operating range for typical automotive engine-cooling fan assemblies includes values between about 0.7 to 1.5. Idle operation is the most important point for fan assembly performance. Typical idle operating points range from 1.3 to 1.5. Thus, this range of fan assembly operation is most important for performance evaluation of the fan assembly.

The "pumping" performance of fan assembly 10 is defined as the speed that fan assembly 10 must turn to deliver a given airflow performance. Pumping, or the flow-to-speed ratio, changes as a function of pressure rise and flow operation point of fan assembly 10. It is desirable to provide fan assembly 10 with both high pumping and high operation efficiency (eta, $\eta$). Comparisons of performance between fan assemblies must be made taking into account differences in both pumping and efficiency performance.

The difficulty in designing a high-pumping, high-efficiency, low-noise fan is apparent from Table 1 above. By increasing camber, chord, or pitch, both pumping and noise are increased. In contrast, measures taken to reduce noise also reduce pumping. A proper balance of trade-offs like these is crucial for meeting the fan design objectives. To produce a fan with high-pumping, high-efficiency, and low-noise, the four, key, blade parameters are distributed across the blade span as described below.

A. Blade Sweep

A blade with planform curvature produces lower airborne noise than a blade with a straight planform. Even with optimized pressure loading of blade 100, however, there is still a drop in net air-moving performance associated with the curved planform blade. This performance loss is the result of the downwash that exists on any swept blade. "Downwash" is the term used to describe the upstream tangential velocity component that is induced by trailing-edge vortices. This induced tangential velocity reduces the effective angle of attack ($\alpha$) of airfoil 30 and, consequently, reduces lift and blade pumping. See the airfoil inlet velocity diagram of FIG. 2.

Several alternatives exist for recovering the airfoil performance lost to downwash on curved planform blades. One solution is to operate fan assembly 10 having curved planform blades 100 at a higher speed to match the airflow of straight planform blades. This alternative is undesirable because the noise increases at the higher speed. Another option is to increase the pitch angles (P) of airfoil 30, which will increase pumping and deliver the required flow without an increase in speed. Although this option may not increase the fan noise, a deeper fan package is required because the fan depth is a function of airfoil pitch expressed by:

$$D(r)=C(r)\times\sin(P(r)), \quad (1)$$

where D(r) is the blade depth at radius r, C(r) is the airfoil chord, and P(r) is the airfoil pitch angle. With the restriction in available underhood space in modern automobiles, it is important to keep the depth (D) as small as possible.

Figure 7:
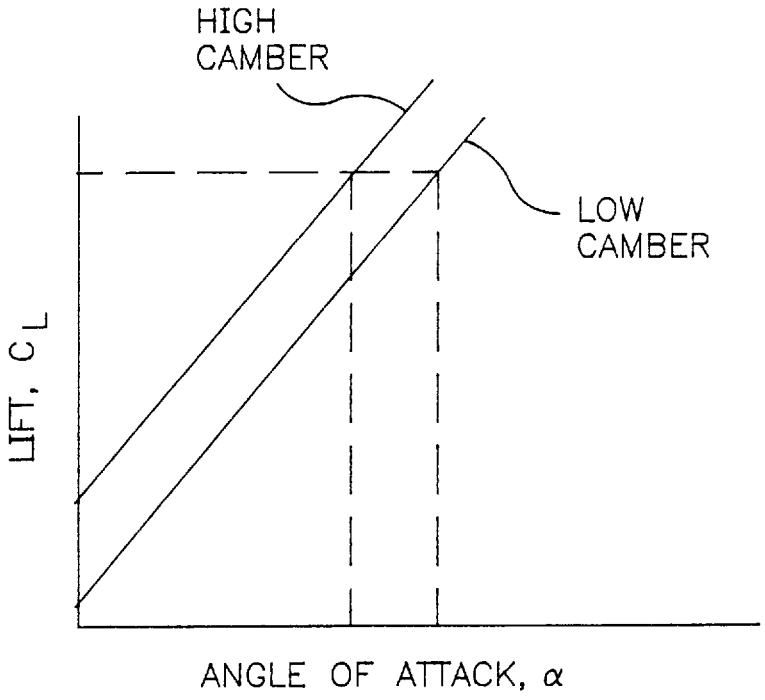
FIG. 7 is a graph of coefficient of lift ($C_L$) versus angle of attack (α) for a typical airfoil with higher and lower camber.

Another alternative is to increase the chord length (C). This alternative will increase the lift of airfoil 30 and the pumping that blade 100 can produce. An increase in chord C(r) produces an increase in depth D(r), however, as given in equation (1) above. A fourth approach is to modify the design of airfoil 30 itself to create more lift (and, thereby, more pumping) without increasing pitch angle (P) or chord (C) of airfoil 30. As mentioned above, airfoil lift increases with increased camber. To produce equivalent lift with a cambered airfoil 30, pitch angle (P) of airfoil 30 can be reduced. This is shown in FIG. 7, which is a graph of coefficient of lift ($C_L$) versus angle of attack ($\alpha$) for an airfoil with higher and lower camber.

Figure 4:
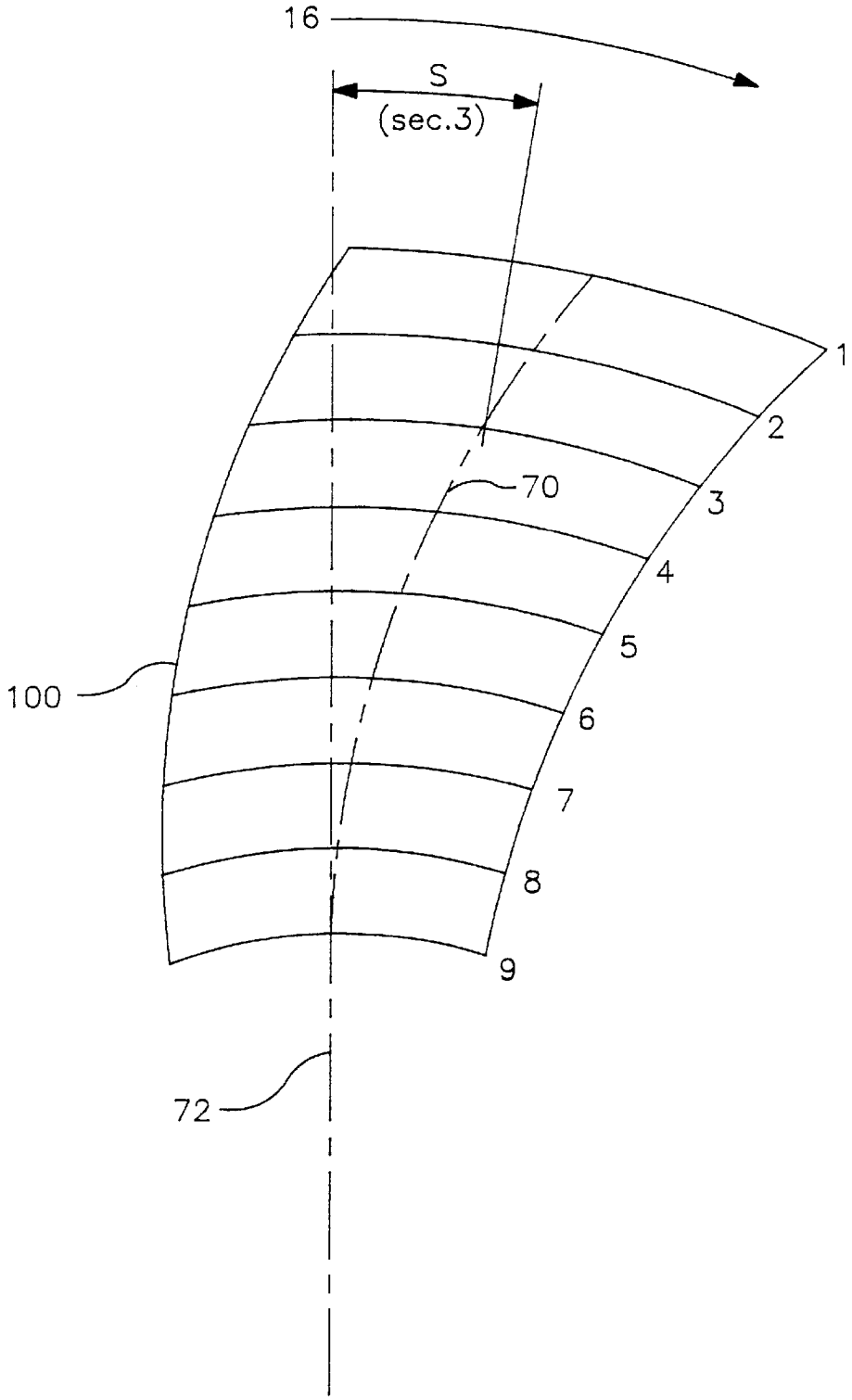
FIG. 4 illustrates the skew or sweep angle, S, defined as the angular position of the planform mean-curve relative to a radial spacing line.
Figure 5:
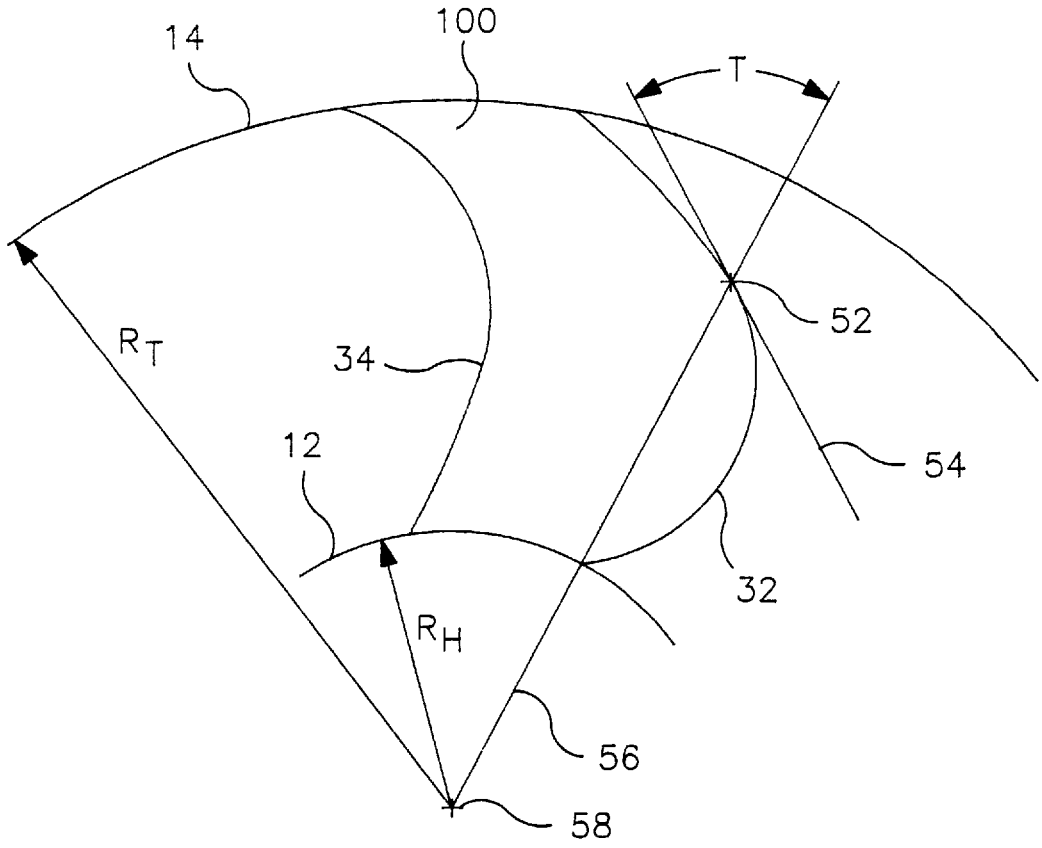
FIG. 5 illustrates the leading-edge sweep or skew angle, T.

Blade 100 of the present invention is provided with a unique, skewed (or curved) planform to increase fan performance. The skew refers to the sweep or planform curvature of blade 100 and is illustrated in FIGS. 4 and 5. The magnitude of sweep is defined by the skew angle and can be measured in at least two ways. Skew or sweep, S, may be defined as the angular position of the planform mean-curve 70 relative to a radial spacing line 72 (see FIG. 4). As shown in FIG. 4, nine sections were taken along blade 100. Section "1" is the section at the blade tip. The sweep angle illustrated in FIG. 4 is that for section 3 of blade 100.

Alternatively, sweep could also be measured at leading edge 32 of blade 100. FIG. 5 illustrates leading edge sweep (skew) angle, T. At an arbitrary point 52 on leading edge 32 of blade 100, the skew angle is the angle "T" between a tangent 54 to leading edge 32 through point 52 and a line 56 from the center 58 of hub 12 (and the center of fan assembly 10) through point 52. The inventors have adopted the first definition of skew, the planform mean-curve sweep angle (S), and this definition is used consistently below.

Pumping decreases with increasing blade sweep, although a moderate amount of sweep can be used to reduce noise without a significant decrease in pumping. To achieve high pressure rise, forward blade sweep is preferred, as shown in FIG. 4. For best results, blade 100 is forward-swept with a sweep angle (S) of 0° at the blade root, continuously increasing with radius to a maximum absolute value sweep angle (S) not exceeding about 15° at the blade tip. See Table 3 below. As used in this application, the word "about" is interchangeable with similar terms, such as "approximately" and "close proximity," and is intended to avoid a strict numerical boundary on the specified parameter.

Figure 6:
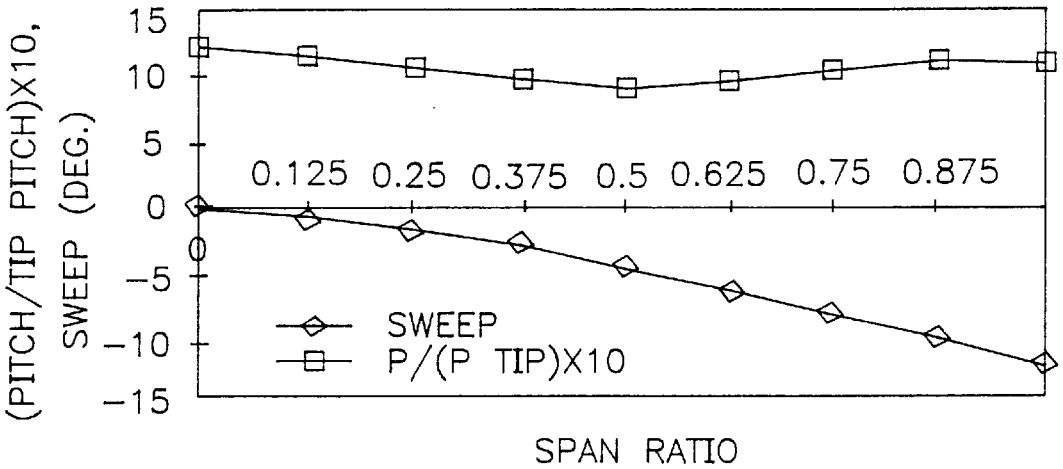
FIG. 6 illustrates the distribution along the span of both the blade sweep angle and the pitch angle for the blade of the present invention.

A plot of blade sweep angle (S) versus span ratio for blade 100 according to the present invention is shown in FIG. 6. The span of blade 100 is defined as $R_T$–$R_H$, where $R_T$ is the tip radius and $R_H$ is the hub radius. See FIG. 5. Span ratio is defined as $[(r-R_H)/(R_T-R_H)]$, where r is the local radius.

B. Airfoil Pitch Angle

Blade 100 of the present invention is provided with a unique distribution of pitch angle (P). Blade 100 is composed of airfoil cross-sections 30 (see FIG. 2), which continuously vary in pitch angle (P) from root to tip. For optimum fan performance, airfoil 30 is pitched such that the angle between the chord line and the onset flow vector ($V_{rel}$) forms the desired airfoil angle of attack ($\alpha$). In the preferred embodiment of the forward-swept blade 100, the pitch distribution has three unique characteristics (see Table 3 and FIG. 6) defining three, separate regions.

First, pitch angle (P) of airfoil 30 continuously increases from the blade tip to about the ⅞-span location; pitch angle (P) at the ⅞-span location does not exceed about 105% of the tip pitch angle. Second, pitch angle (P) of airfoil 30 continuously decreases from about the ⅞-span location to about the ½-span location; pitch angle (P) at the ½-span location is not less than about 80% of the tip pitch angle. Finally, pitch angle (P) of airfoil 30 continuously increases from about the ½-span location to the blade root; pitch angle (P) at the blade root does not exceed about 120% of the tip pitch angle.

The three regions defined by the pitch angle (P) can also be viewed from the blade root to the blade tip. When so viewed, the three, separate regions defined by the airfoil pitch angle (P) of the forward-swept blade 100 are: (a) a first region in which the pitch angle continuously decreases from the root to about the ½-span location, (b) a second region in which the pitch angle continuously increases from about the ½-span location to about the ⅞-span location, and (c) a third region in which the pitch angle continuously decreases from about the ⅞-span location to the tip.

C. Airfoil Camber

An airfoil with higher camber provides increased lift verses an airfoil with lower camber—at the same angle of attack. This is illustrated by FIG. 7, which is a graph of coefficient of lift ($C_L$) versus angle of attack ($\alpha$) for an airfoil with higher and lower camber.

Figure 8:
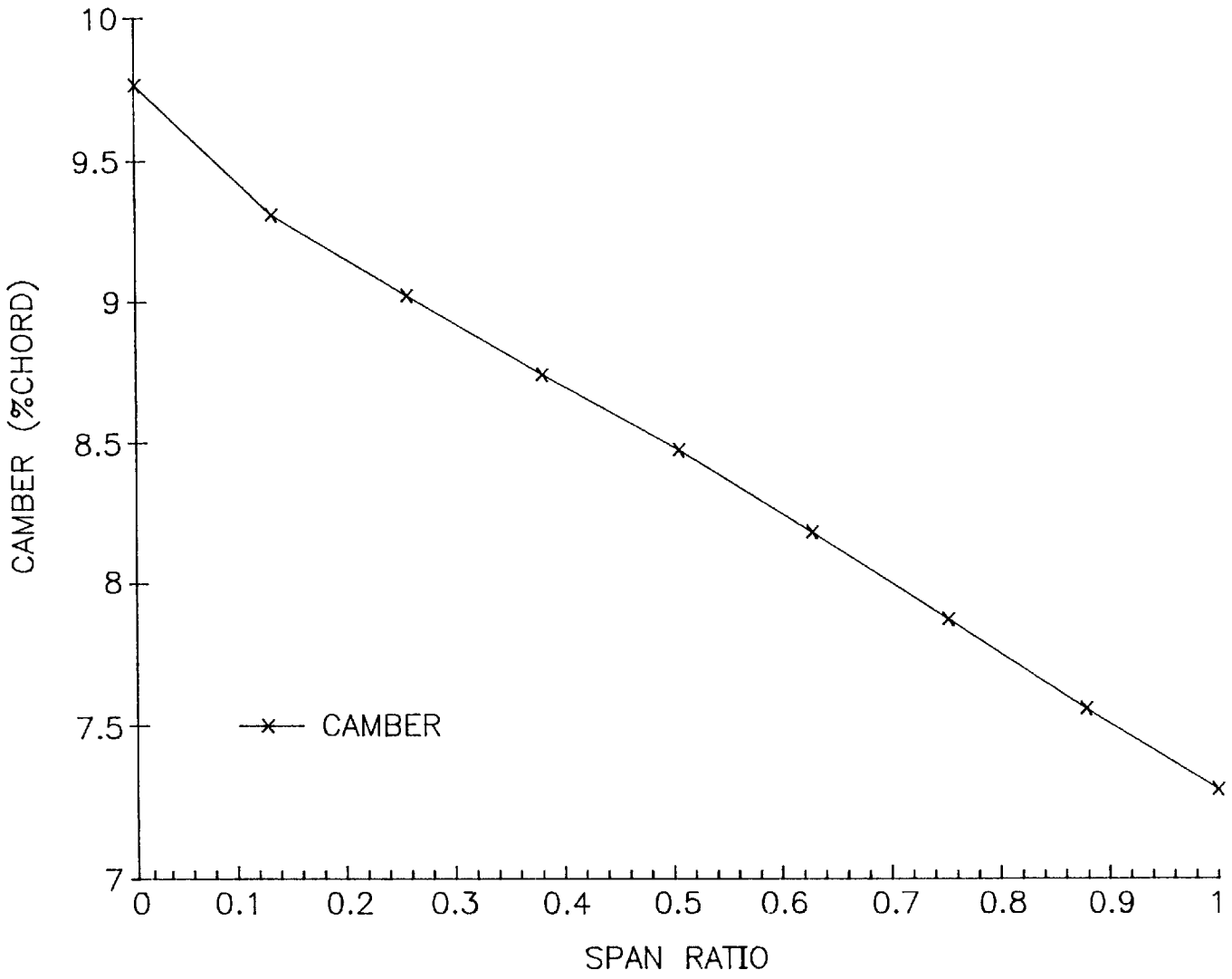
FIG. 8 is a graph of maximum camber ($b_{max}$), expressed in percentage of local chord, versus span ratio for the blade of the present invention.

As with airfoil pitch angle (P), the camber (b, see FIG. 2) of the preferred embodiment of airfoil 30 of blade 100 varies continuously from tip to root. See Table 3 below. Maximum camber ($b_{max}$), expressed in percentage of local chord, is plotted against span ratio in FIG. 8. To provide a uniform spanwise pressure loading, airfoil camber (b) continuously increases from a value not less than about 5% of chord at the blade tip to a value not greater than about 12% of chord at the blade root.

D. Airfoil Chord (and Solidity)

Figure 2:
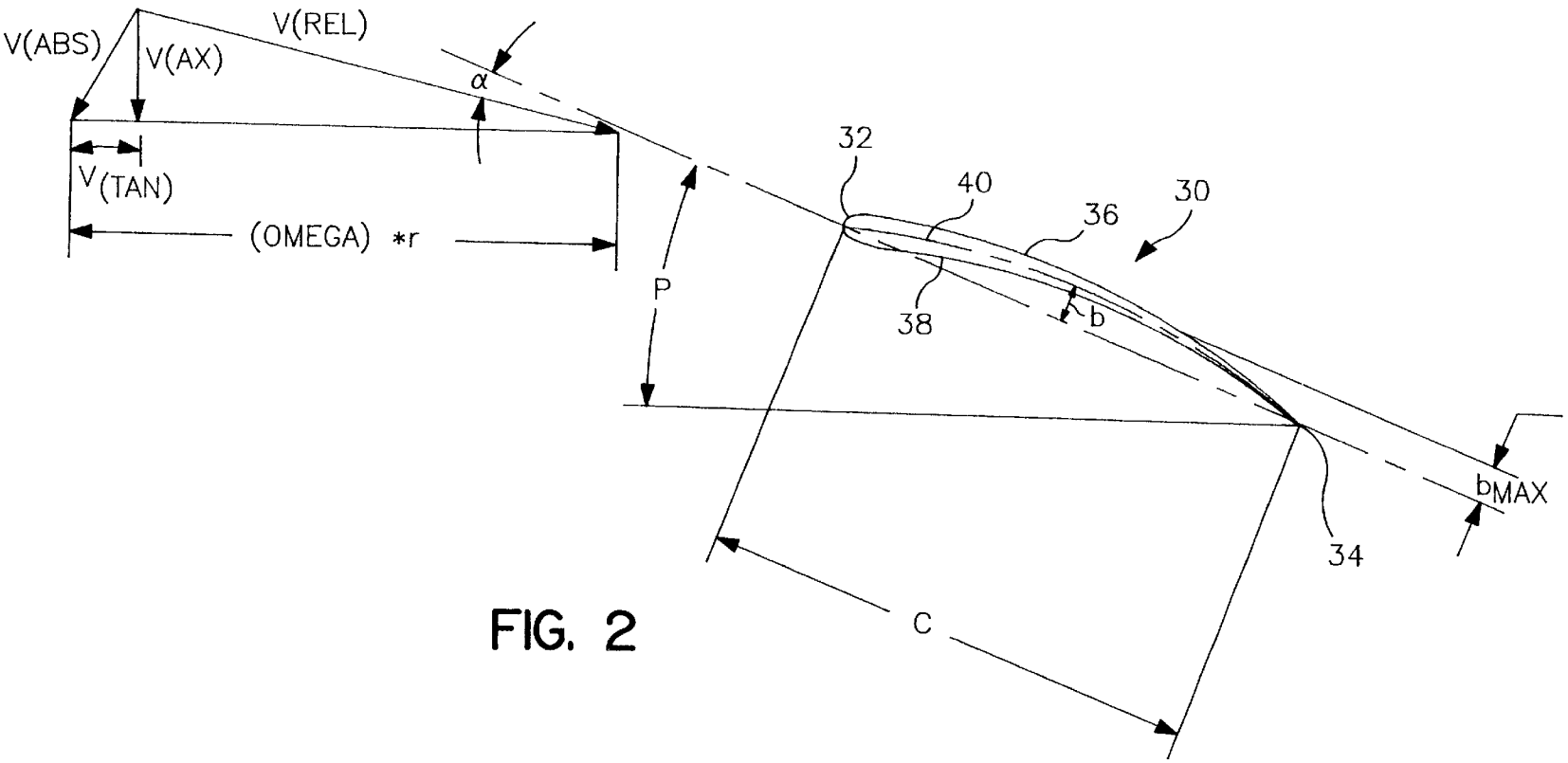
FIG. 2 is a cross-sectional view of an airfoil of the blade of the present invention, illustrating an exemplary inlet velocity triangle.
Figure 3:
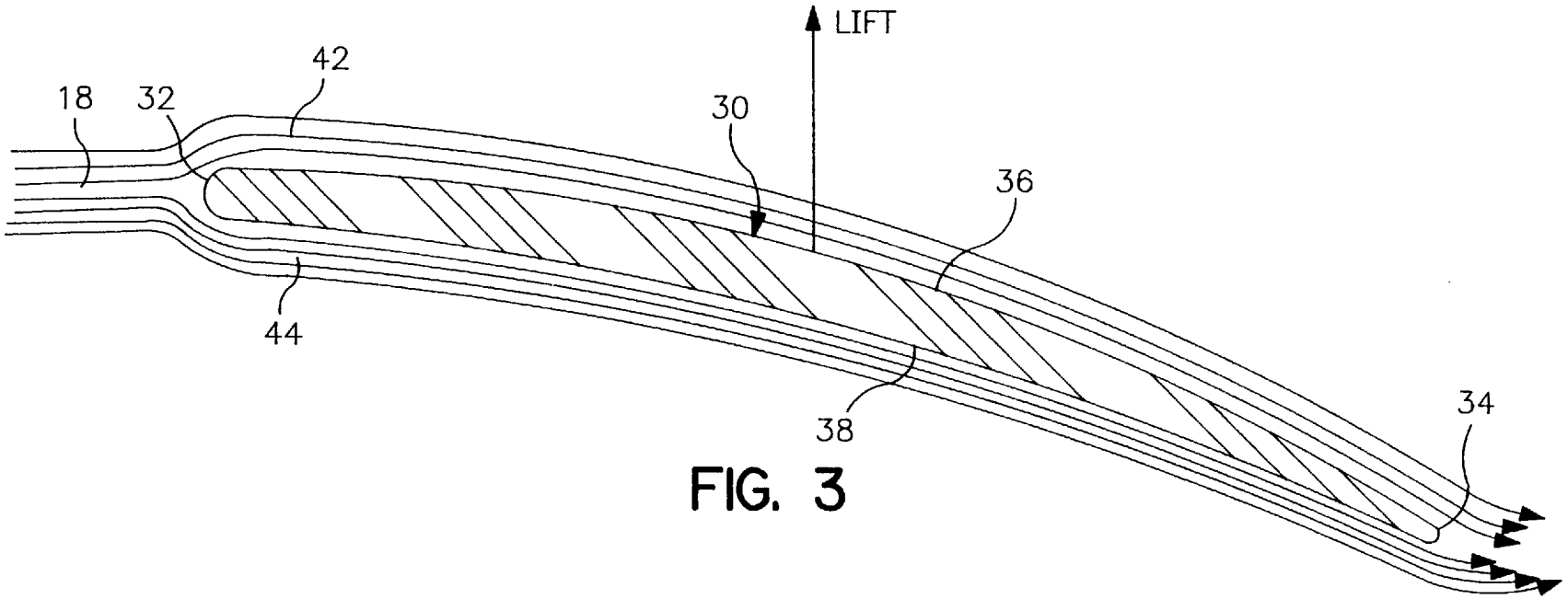
FIG. 3 illustrates the airfoil, shown in FIG. 2, in an airstream.

The chord (C) of airfoil 30 is the line connecting the airfoil leading edge 32 and trailing edge 34 (see FIG. 2). An increase in chord (C) produces an increase in airfoil lifting force and blade pumping, up to a point. If airfoil chord (C) is large relative to the circumferential gap between adjacent airfoils 30, airfoils 30 are said to be "crowded." Pumping declines if blades 100 are too crowded (i.e., the ratio of chord-to-gap is too large). The ratio of chord to gap is called solidity ($\sigma$):

$$\sigma = \frac{c(r)}{\frac{2}{N}\pi r}, \tag{2}$$

where C(r) is the airfoil chord at radius r; N is the number of blades; and r is the local radius.

Figure 1:
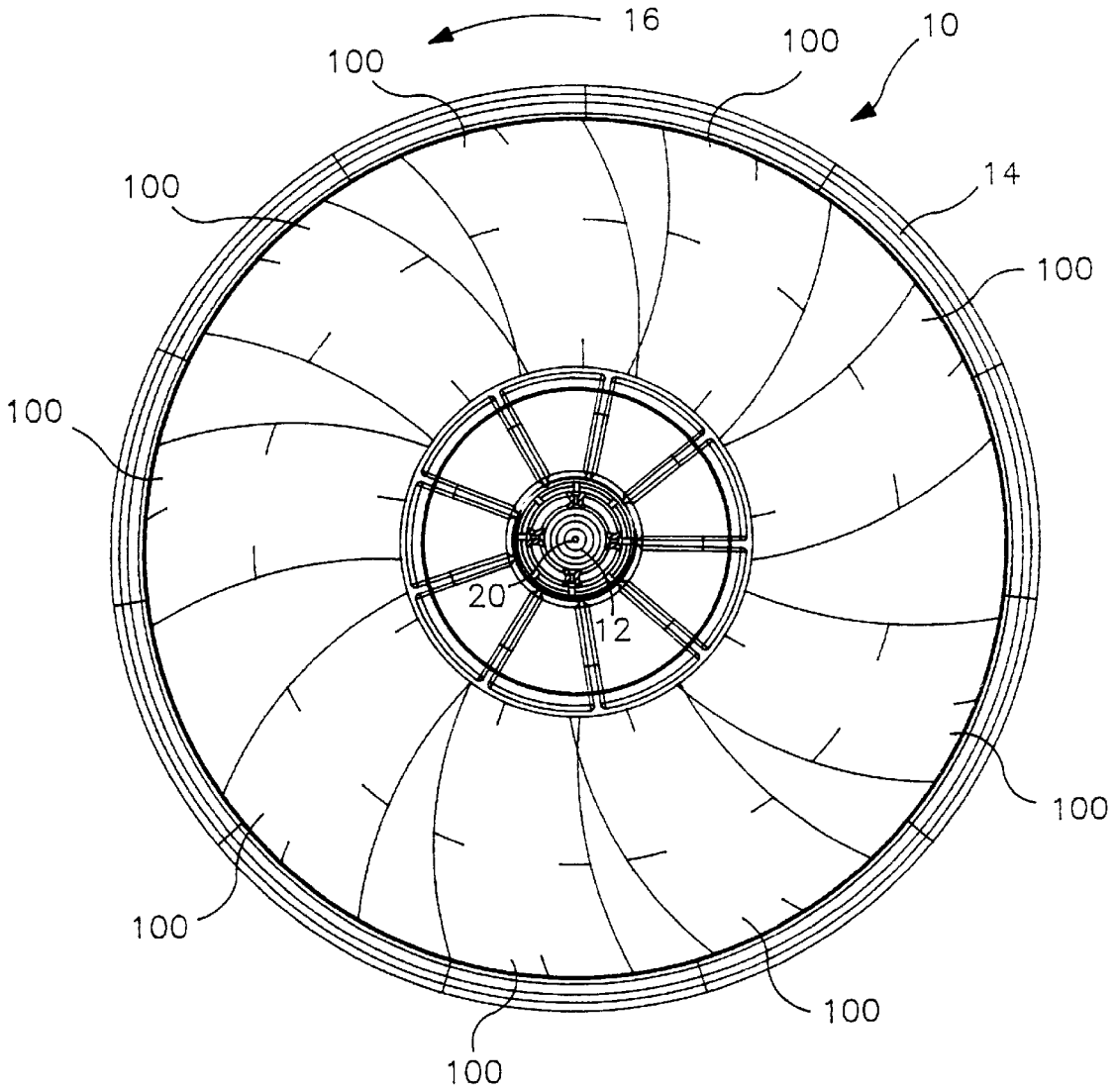
FIG. 1 is a front elevational view of a multi-bladed cooling air fan assembly incorporating blades having the airfoil and planform of the present invention.

Blade 100 of the present invention is provided with a unique distribution of airfoil chord. In the preferred embodiment, airfoil chord decreases from the blade tip to the blade root; the spanwise distribution of chord is substantially linear. Solidity ($\sigma$) is not less than about 0.5 at the blade tip and continuously increases along the span to a value not greater than about 1.1 at the blade root. The solidities of the nine-bladed fan assembly 10 shown in FIG. 1 are compared with the solidifies of seven and eleven-bladed fan assemblies in Table 2 below. (Note that the blade chords of the eleven-bladed fan assembly are different from those of the seven and nine-bladed fan assemblies.)

TABLE 2

| Span Ratio | Solidities (7) | Solidities (9) | Solidities (11) |
|---|---|---|---|
| 1 | 0.506 | 0.651 | 0.636 |
| 0.875 | 0.526 | 0.677 | 0.664 |
| 0.75 | 0.54 | 0.695 | 0.684 |
| 0.625 | 0.563 | 0.723 | 0.717 |
| 0.5 | 0.592 | 0.761 | 0.76 |
| 0.375 | 0.631 | 0.811 | 0.817 |
| 0.25 | 0.679 | 0.874 | 0.89 |
| 0.125 | 0.737 | 0.948 | 0.98 |
| 0 | 0.82 | 1.054 | 1.052 |

Figure 9:
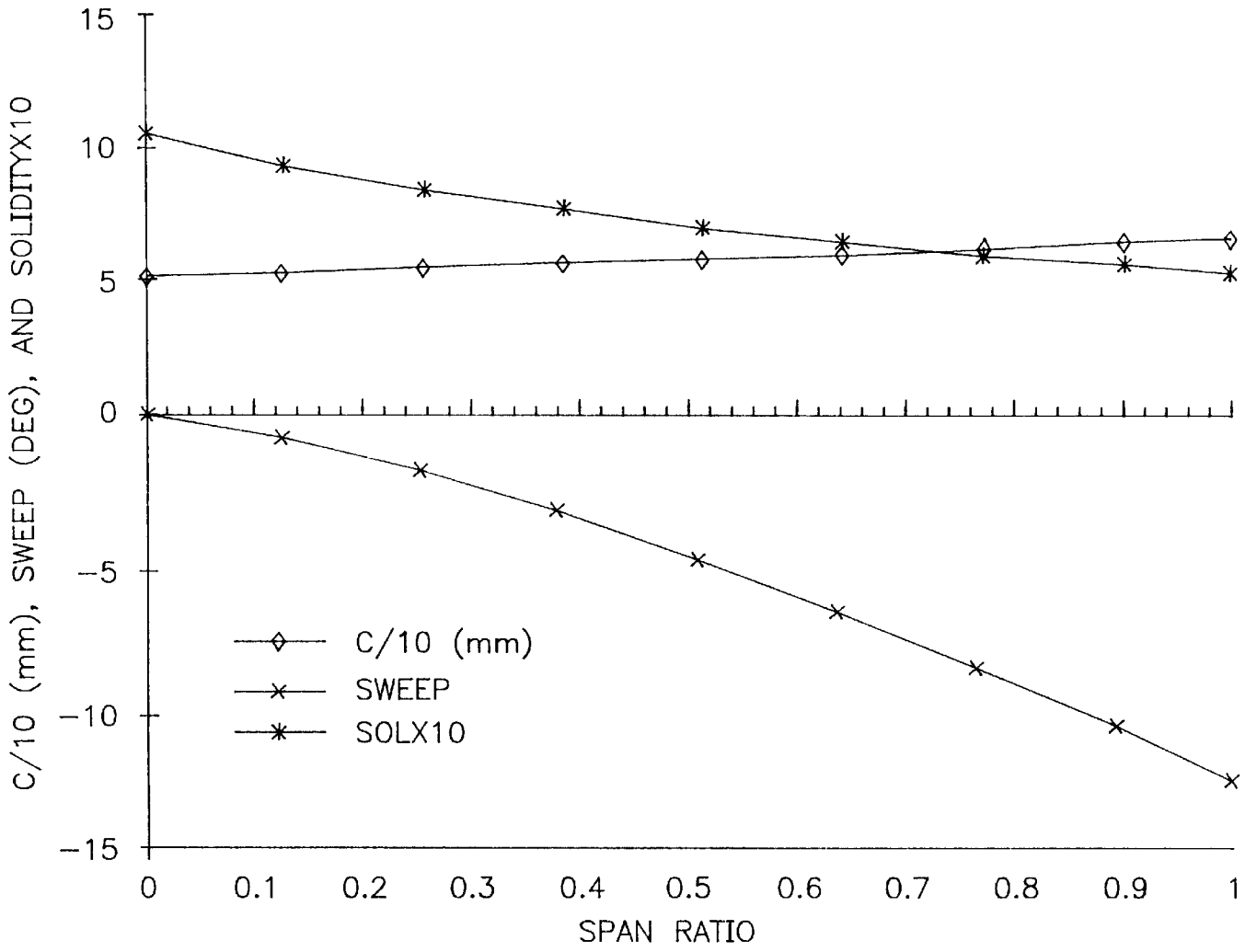
FIG. 9 shows graphs of chord, solidity, and blade sweep versus span ratio for the blade of the present invention.

Chord, solidity, and blade sweep are summarized in Table 3 below and are plotted versus span ratio in FIG. 9. For a given value of solidity ($\sigma$), at one radius (r), many combinations of chord and blade number may be used. To achieve the design objectives set forth in this application, the preferred number of blades 100 is between five and eleven. With a fixed value of radius, solidity, and blade number, the chord can be calculated directly from Equation (2) above.

In FIG. 6, the blade sweep is shown on the same plot as pitch angle. In FIG. 9, blade sweep is shown with chord and solidity. The spanwise distributions of pitch angle (FIG. 6) and of chord and solidity (FIG. 9) are functions of the particular sweep distribution described herein. For a different distribution of blade sweep, new distributions of pitch angle and chord/solidity would have to be determined.

During the development of the high-pressure rise, low-noise fan assembly 10 of the present invention, several blade sweep distributions were considered. It was discovered that both pitch angle (P) and chord/solidity ($C/\sigma$) are strongly influenced by the magnitude of planform sweep. The performance reduction resulting from excessive forward sweep angles (S) can be reversed by increasing either pitch angle (P), chord (C), or both, in the region of the span near the blade tip. Large pitch angles and large chords contribute, however, to increased fan depth, mass, and cost.

Fan assembly 10 according to the present invention represents an acceptable compromise between pumping, noise, efficiency, mass, and fan depth. The following Table 3 summarizes a preferred embodiment of the blades 100 of the present invention:

TABLE 3

| Rad (mm) | Span Ratio | C (mm) | C/10 (mm) | Sweep (mm) | Sweep° | Pitch ang. (°) | P/(P tip) × 10 | Sol × 10 | Cam/C (%) |
|---|---|---|---|---|---|---|---|---|---|
| 174 | 1 | 79.07 | 7.907 | 39.242 | −12.922 | 22.5 | 10 | 6.51 | 7.309 |
| 161 | 0.875 | 76.09 | 7.609 | 29.952 | −10.659 | 23.5 | 10.44 | 6.77 | 7.589 |
| 148 | 0.75 | 71.77 | 7.177 | 22.375 | −8.662 | 21.8 | 9.69 | 6.95 | 7.902 |
| 135 | 0.625 | 68.19 | 6.819 | 15.786 | −6.7 | 20 | 8.89 | 7.23 | 8.205 |
| 122 | 0.5 | 64.83 | 6.483 | 10.361 | −4.866 | 19.2 | 8.53 | 7.61 | 8.493 |
| 109 | 0.375 | 61.71 | 6.171 | 6 | −3.154 | 20.8 | 9.24 | 8.11 | 8.765 |
| 96 | 0.25 | 58.55 | 5.855 | 2.915 | −1.74 | 23.2 | 10.31 | 8.74 | 9.037 |
| 83 | 0.125 | 54.92 | 5.492 | 0.976 | −0.674 | 25.5 | 11.33 | 9.48 | 9.313 |
| 70 | 0 | 51.5 | 5.15 | 0 | 0 | 26.8 | 11.91 | 10.54 | 9.769 |

Figure 10:
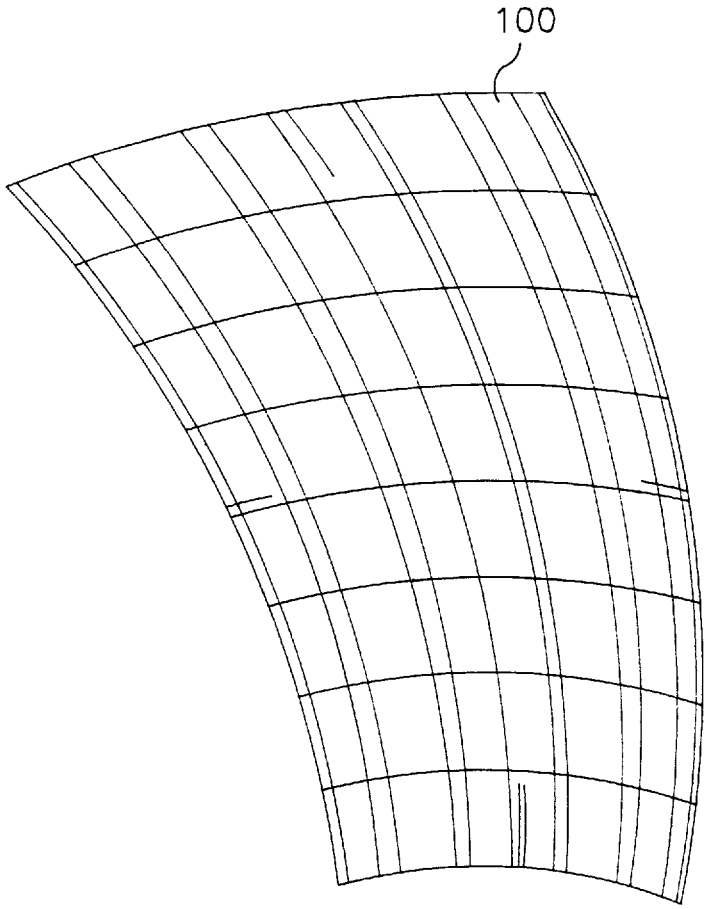
FIG. 10 illustrates a blade having a highly curved blade planform in accordance with the present invention.

From left to right, the columns in Table 3 represent the following parameters. "Rad (mm)" is the radius along blade 100 where airfoil 30 is taken. As shown in FIG. 4, nine sections were taken. Section "1" is the section at the blade tip and is the first row of the table. "Span Ratio" is defined above as $[(r-R_H)/(R_T-R_H)]$, where r is the local radius. "C" is the chord in millimeters and "C/10" is simply the chord divided by ten, also in millimeters. "Sweep" is the angular position of the planform mean-curve relative to a radial spacing line (FIG. 4), measured in millimeters of arc length. Sweep angle (S) in degrees is then calculated by dividing the sweep in millimeters by the radius in millimeters to obtain the sweep angle in radians, which is then converted to degrees. The pitch angle (P) is illustrated in FIG. 2. The ratio of pitch angle to pitch angle at the blade tip is multiplied by ten to obtain the data of the next column. "So1×10" is the solidity, which is defined above and is dimensionless, multiplied by ten. Finally, "Cam/C" is the camber (defined above) divided by the chord and is expressed as a dimensionless percentage. FIG. 10 illustrates blade 100 having a highly curved blade planform in accordance with the present invention.

E. Comparisons

Tables illustrating similar characteristics for the blades disclosed in three issued patents are provided below.

Figure 11:
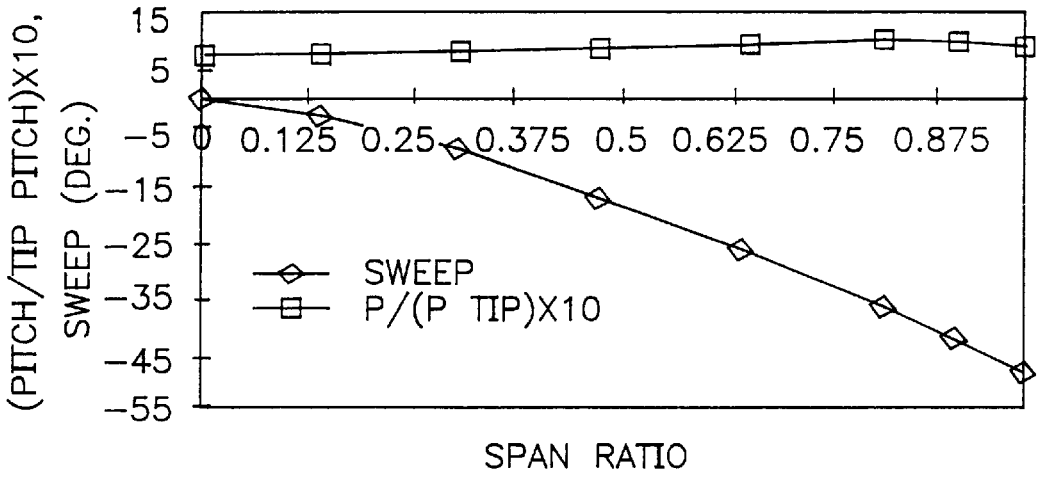
FIG. 11 PRIOR ART
FIG. 11 illustrates the distribution along the span of both the blade sweep angle and the pitch angle for the blade disclosed in the '245 patent.

FIG. 11 illustrates the distribution along the span of both the blade sweep angle and the pitch angle for the blade disclosed in the '245 patent. Turning first to the pitch angle of the '245 fan blade, the data show that the blade has a constantly (almost linearly) decreasing pitch angle from tip to root. The '245 blade does not have a pitch angle defining three, separate regions as does blade 100 of the present invention. In addition, the blade sweep angle of the '225 fan blade has an absolute value of almost 50° at the blade tip—well in excess of the 15° limit specified for blade 100 of the present invention.

TABLE 4

(The Blade of U.S. Pat. No. 4,358,245 Issued to Gray)

| Rad (mm) | Span Ratio | C (mm) | C/10 (mm) | Sweep (mm) | Sweep° | Pitch ang. (°) | P/(P tip) × 10 | Sol × 10 | Cam/C (%) |
|---|---|---|---|---|---|---|---|---|---|
| 182.88 | 1 | 76.2 | 7.62 | 156.972 | −49.1789 | 39 | 10 | 3.315731 | 2 |
| 173.736 | 0.914286 | 81.026 | 8.1026 | 130.81 | −43.1394 | 36.5 | 9.358974 | 3.711292 | 2.5 |
| 164.592 | 0.828571 | 86.36 | 8.636 | 109.22 | −38.0203 | 33.9 | 8.692308 | 4.175365 | 2.8 |
| 146.304 | 0.657143 | 93.98 | 9.398 | 71.12 | −27.8521 | 30.1 | 7.717949 | 5.111752 | 3.3 |
| 128.016 | 0.485714 | 97.028 | 9.7028 | 41.148 | −18.4165 | 29.3 | 7.512821 | 6.031472 | 3.8 |
| 109.728 | 0.314286 | 94.742 | 9.4742 | 19.05 | −9.94718 | 28.4 | 7.282051 | 6.870931 | 4.1 |
| 91.44 | 0.142857 | 86.868 | 8.6868 | 5.842 | −3.66056 | 28.1 | 7.205128 | 7.559866 | 4.3 |
| 76.2 | 0 | 76.2 | 7.62 | 0 | 0 | 28 | 7.179487 | 7.957754 | 4.5 |

TABLE 5

(The Blade of U.S. Pat. No. 5,244,347 Issued to Gallivan et al.)

| Rad (mm) | Span Ratio | C (mm) | C/10 (mm) | Sweep (mm) | Sweep° | Pitch ang. (°) | P/(P tip) × 10 | Sol × 10 | Cam/C (%) |
|---|---|---|---|---|---|---|---|---|---|
| 190.8 | 1 | 29 | 2.9 | 118.821 | −35.681 | 18.58 | 10 | 2.419022 | 3.058 |
| 182.9 | 0.933221 | 30 | 3 | 90.649 | −28.397 | 19.99 | 10.75888 | 2.610524 | 3.058 |
| 173.3 | 0.852071 | 30 | 3 | 76.248 | −25.209 | 21.64 | 11.64693 | 2.755135 | 3.277 |
| 154 | 0.688926 | 30 | 3 | 52.514 | −19.538 | 18.24 | 9.817008 | 3.100421 | 3.058 |

TABLE 5-continued (The Blade of U.S. Pat. No. 5,244,347 Issued to Gallivan et al.)

| Rad (mm) | Span Ratio | C (mm) | C/10 (mm) | Sweep (mm) | Sweep° | Pitch ang. (°) | P/(P tip) × 10 | Sol × 10 | Cam/C (%) |
|---|---|---|---|---|---|---|---|---|---|
| 134.8 | 0.526627 | 30 | 3 | 38.134 | −18.208 | 15.69 | 8.444564 | 3.542024 | 3.058 |
| 115.5 | 0.363483 | 31 | 3.1 | 23.025 | −11.422 | 15.05 | 8.100108 | 4.271691 | 3.277 |
| 96.3 | 0.201183 | 40 | 4 | 11.553 | −6.874 | 15.47 | 8.326157 | 6.610797 | 3.277 |
| 77 | 0.038039 | 46 | 4.6 | 0.168 | −0.125 | 18.92 | 10.18299 | 9.507957 | 4.814 |
| 72.5 | 0 | 44 | 4.4 | 0 | 0 | 20.39 | 10.97417 | 9.659058 | 5.918 |

Figure 12:
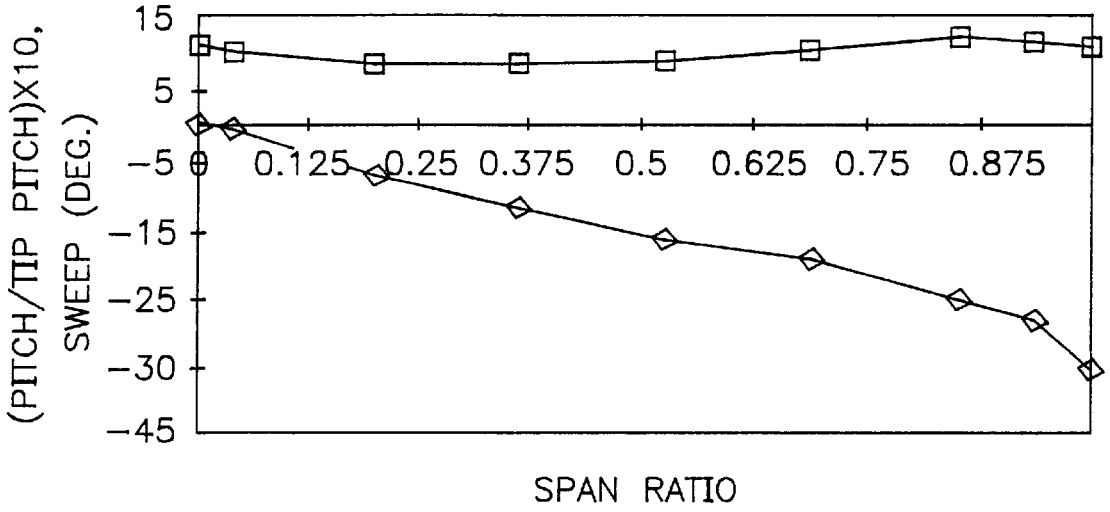
FIG. 12 PRIOR ART
FIG. 12 illustrates the distribution along the span of both the blade sweep angle and the pitch angle for the blade disclosed in the '347 patent.

FIG. 12 illustrates the distribution along the span of both the blade sweep angle and the pitch angle for the blade disclosed in the '347 patent. Turning first to the pitch angle of the '347 fan blade, the data show that the '347 blade—like blade 100 of the present invention—defines three, separate regions. The regions of the '347 blade transition at about ⅞ and ⅜ span; in contrast, blade 100 of the present invention transitions at about the ⅞-span and ½-span locations. In addition, the blade sweep angle of the '347 fan blade has an absolute value of over 35° at the blade tip—well in excess of the 15° limit specified for blade 100 of the present invention. Also unlike blade 100 of the present invention, the '347 blade does not have a continuously increasing maximum camber ($b_{max}$) from blade tip to blade root.

It should be noted that the '347 patent fails to specify how the blade sweep angles for the '347 blade are calculated. The patent defines the skew angles as leading edge skew angles but does not specify whether such angles are defined by leading edge tangent lines (see angle "T" in FIG. 5) or by the angle between a vertical line and a line through the blade leading edge. The '225 patent used the angle-from-vertical definition. Because both the '225 and '347 patents were prosecuted by the same parties and were assigned to the same entity, it has been assumed that the '347 patent also uses the angle-from-vertical definition.

separate regions in which it continuously increases from the blade tip to about the ⅞-span location, continuously decreases to about the ½-span location, and continuously increases to the blade root; a continuously increasing maximum camber ($b_{max}$) from blade tip to blade root; and continuously increasing solidity (σ) from blade tip to blade root gives blade 100 uniquely efficient performance characteristics. Specifically, fan assembly 10 with blades 100 has high operating efficiency, low noise, and high pumping characteristics.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention. The engine-cooling fan assembly in which the airfoil of the present invention is incorporated, for example, may be powered by a fan clutch, an electric motor, or an hydraulic motor and may be used with or without an attached rotating ring.

What is claimed is:

1. A blade adapted for use in a vehicle engine-cooling fan assembly and having a root, a tip, and a span between said root and said tip, said blade comprising:

TABLE 6

(The Blade of U.S. Pat. No. 5,326,225 Issued to Gallivan et al.)

| Rad (mm) | Span Ratio | C (mm) | C/10 (mm) | Sweep (mm) | Sweep° | Pitch ang. (°) | P/(P tip) × 10 | Sol × 10 | Cam/C (%) |
|---|---|---|---|---|---|---|---|---|---|
| 168.5 | 1 | 39 | 3.9 | 45.29 | −15.4 | 17.2 | 10 | 2.578593 | 4.374 |
| 156.5 | 0.875 | 46 | 4.6 | 21.852 | −8 | 17.7 | 10.2907 | 3.274626 | 3.716 |
| 144.5 | 0.75 | 49 | 4.9 | 11.097 | −4.4 | 17.7 | 10.2907 | 3.777865 | 3.716 |
| 132.5 | 0.625 | 53 | 5.3 | 2.775 | −1.2 | 16.9 | 9.825581 | 4.456338 | 3.716 |
| 120.5 | 0.5 | 57 | 5.7 | 1.893 | 0.9 | 15.1 | 8.77907 | 5.269944 | 3.716 |
| 108.5 | 0.375 | 59 | 5.9 | 4.545 | 2.4 | 14.2 | 8.255814 | 60.58156 | 3.935 |
| 96.5 | 0.25 | 65 | 6.5 | 6.232 | 3.7 | 14.1 | 8.197674 | 7.504197 | 4.155 |
| 84.5 | 0.125 | 68 | 6.8 | 3.687 | 2.5 | 14.4 | 8.372093 | 8.965414 | 5.92 |
| 72.5 | 0 | 63 | 6.3 | 0 | 0 | 18.3 | 10.63953 | 9.681011 | 9.267 |

Figure 13:
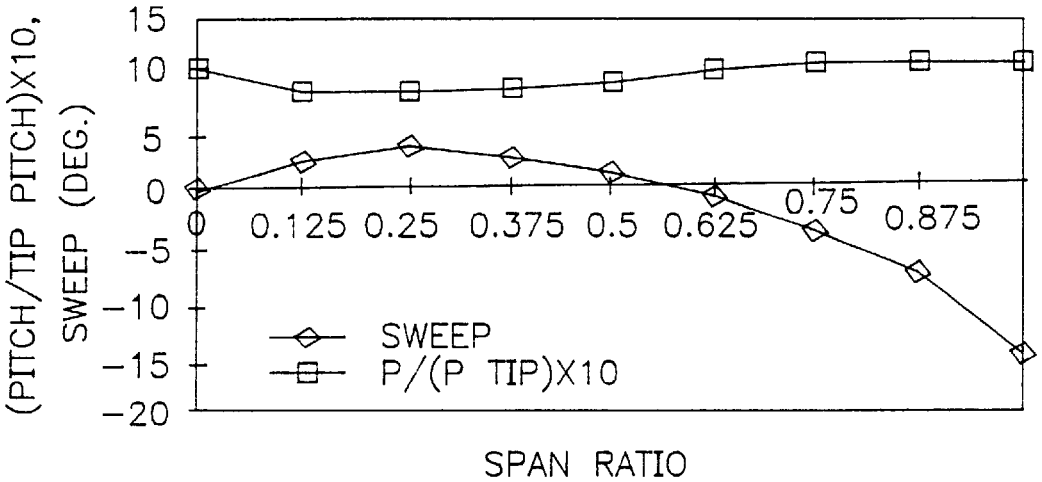
FIG. 13 PRIOR ART
FIG. 13 illustrates the distribution along the span of both the blade sweep angle and the pitch angle for the blade disclosed in the '225 patent.

FIG. 13 illustrates the distribution along the span of both the blade sweep angle and the pitch angle for the blade disclosed in the '225 patent. Focusing on the blade sweep of the '225 fan blade, the data show that the blade is backwardly skewed in the root region adjacent the hub of the fan assembly and forwardly skewed in the tip region. A short, abrupt transition region between the root region of backward skew and the tip region of forward skew occurs between a span ratio of 0.5 and 0.625. The '225 blade does not have a continuously increasing forward sweep angle (S) as does blade 100 of the present invention. Nor does the '225 blade have a continuously increasing maximum camber ($b_{max}$) from blade tip to blade root.

The design combination of a continuously increasing forward sweep angle (S); a pitch angle (P) defining three, a planform having a forward sweep angle continuously increasing in absolute value along said span from said root to said tip; and an airfoil having a pitch angle defining three, separate regions:

(a) a first region in which said pitch angle continuously decreases from said root to about the ½-span location, (b) a second region in which said pitch angle continuously increases from about the ½-span location to about the ⅞-span location, and (c) a third region in which said pitch angle continuously decreases from about the ⅞-span location to said tip.

2. The blade according to claim 1 wherein said sweep angle has a maximum absolute value not exceeding about 15 degrees at the blade tip.

3. The blade according to claim 1 wherein said pitch angle has a value at about the ⅞-span location not exceeding about 105% of the tip pitch angle, a value at about the ½-span location not less than about 80% of the tip pitch angle, and a value at said root not exceeding about 120 % of the tip pitch angle.

4. The blade according to claim 1 wherein said airfoil has a maximum camber that continuously decreases from said root to said tip.

5. The blade according to claim 4 wherein said airfoil has a chord and a maximum camber that continuously decreases from a value not greater than about 12% of chord at said root to a value not less than about 5% of chord at said tip.

6. The blade according to claim 1 wherein said airfoil has a chord that continuously increases from said root to said tip.

7. The blade according to claim 6 wherein said airfoil has a solidity not greater than about 1.1 at said root and not less than about 0.5 at said tip.

8. The blade according to claim 1 wherein:

said sweep angle has a maximum absolute value not exceeding about 15 degrees at the blade tip;

said pitch angle has a value at about the ⅞-span location not exceeding about 105% of the tip pitch angle, a value at about the ½-span location not less than about 80% of the tip pitch angle, and a value at said root not exceeding about 120% of the tip pitch angle; and said airfoil has a maximum camber that continuously decreases from said root to said tip and a chord that continuously increases from said root to said tip.

9. The blade according to claim 8 wherein said airfoil has a solidity not greater than about 1.1 at said root and not less than about 0.5 at said tip and wherein said maximum camber of said airfoil continuously decreases from a value not greater than about 12% of chord at said root to a value not less than about 5% of chord at said tip.

10. A vehicle fan assembly for circulating air to cool an engine, said fan assembly comprising:

a central hub; and a plurality of blades each with a root joined to said hub, a tip, a span between said root and said tip, a planform having a forward sweep angle continuously increasing in absolute value along said span from said root to said tip, and an airfoil, said blades extending generally radially outward from said hub and each said airfoil having a pitch angle defining three, separate regions:

(a) a first region in which said pitch angle continuously decreases from said root to about the ½-span location, (b) a second region in which said pitch angle continuously increases from about the ½-span location to about the ⅞-span location, and (c) a third region in which said pitch angle continuously decreases from about the ⅞-span location to said tip.

11. The vehicle fan assembly according to claim 10 further comprising an outer ring, said blades extending generally radially outward from said hub to said ring.

12. The vehicle fan assembly according to claim 10 wherein said sweep angle has a maximum absolute value not exceeding about 15 degrees at the blade tip.

13. The vehicle fan assembly according to claim 10 wherein said pitch angle has a value at about the ⅞-span location not exceeding about 105% of the tip pitch angle, a value at about the ½-span location not less than about 80% of the tip pitch angle, and a value at said root not exceeding about 120% of the tip pitch angle.

14. The vehicle fan assembly according to claim 10 wherein said airfoil has a maximum camber that, continuously decreases from said root to said tip.

15. The vehicle fan assembly according to claim 14 wherein said airfoil has a chord and a maximum camber that continuously decreases from a value not greater than about 12% of chord at said root to a value not less than about 5% of chord at said tip.

16. The vehicle fan assembly according to claim 10 wherein said airfoil has a chord that continuously increases from said root to said tip.

17. The vehicle fan assembly according to claim 16 wherein said airfoil has a solidity not greater than about 1.1 at said root and not less than about 0.5 at said tip.

18. The vehicle fan assembly according to claim 10 wherein:

said sweep angle has a maximum absolute value not exceeding about 15 degrees at the blade tip;

said pitch angle has a value at about the ⅞-span location not exceeding about 105% of the tip pitch angle, a value at about the ½-span location not less than about 80% of the tip pitch angle, and a value at said root not exceeding about 120% of the tip pitch angle; and said airfoil has a maximum camber that continuously decreases from said root to said tip and a chord that continuously increases from said root to said tip.

19. The vehicle fan assembly according to claim 18 wherein said airfoil has a solidity not greater than about 1.1 at said root and not less than about 0.5 at said tip and wherein said maximum camber of said airfoil continuously decreases from a value not greater than about 12% of chord at said root to a value not less than about 5% of chord at said tip.

20. A vehicle fan assembly for circulating air to cool an engine, said fan assembly comprising:

a central hub; and a plurality of blades each with a root joined to said hub, a tip, a span between said root and said tip, a planform having a forward sweep angle continuously increasing in absolute value along said span from said root to a maximum absolute value not exceeding about 15 degrees at said tip, and an airfoil, said blades extending generally radially outward from said hub;

each said airfoil having a chord that continuously increases from said root to said tip, a maximum camber that continuously decreases from a value not greater than about 12% of chord at said root to a value not less than about 5% of chord at said tip, a solidity not greater than about 1.1 at said root and not less than about 0.5 at said tip, and a pitch angle defining three, separate regions:

(a) a first region in which said pitch angle continuously decreases from said root, where said pitch angle has a value not exceeding about 120% of the tip pitch angle, to about the ½-span location, (b) a second region in which said pitch angle continuously increases from about the ½-span location, where said pitch angle has a value not less than about 80% of the tip pitch angle, to about the ⅞-span location, and (c) a third region in which said pitch angle continuously decreases from about the ⅞-span location, where said pitch angle has a value not exceeding about 105% of the tip pitch angle, to said tip.

* * * * *